US012129072B2

(12) United States Patent
Bhat et al.

(10) Patent No.: US 12,129,072 B2
(45) Date of Patent: Oct. 29, 2024

(54) FLEXIBLE BASE FOR ASEPTIC-FILL BOTTLES

(71) Applicant: PepsiCo, Inc., Purchase, NY (US)

(72) Inventors: Advait Rasik Bhat, White Plains, NY (US); Martin Mathelier, Garnerville, NY (US)

(73) Assignee: PepsiCo, Inc., Purchase, NY (US)

( * ) Notice: Subject to any disclaimer, the term of this patent is extended or adjusted under 35 U.S.C. 154(b) by 0 days.

(21) Appl. No.: 17/538,646

(22) Filed: Nov. 30, 2021

(65) Prior Publication Data

US 2023/0166882 A1 Jun. 1, 2023

(51) Int. Cl.
*B65D 1/02* (2006.01)

(52) U.S. Cl.
CPC .... *B65D 1/0276* (2013.01); *B65D 2501/0027* (2013.01)

(58) Field of Classification Search
CPC ..... B65D 1/0207; B65D 1/0284; B65D 2501/0009
USPC ..... 215/373, 384, 375, 382
See application file for complete search history.

(56) References Cited

U.S. PATENT DOCUMENTS 4,525,401 A * 6/1985 Pocock ..... B29C 45/26 215/373
5,064,081 A * 11/1991 Hayashi ..... B65D 1/0223 215/381
6,085,924 A * 7/2000 Henderson ..... B65D 1/0284 215/373
6,585,123 B1 7/2003 Pedmo et al.
6,926,163 B2 8/2005 Darr et al.
7,017,763 B2 3/2006 Kelley
D522,368 S 6/2006 Darr et al.
D528,422 S 9/2006 Darr et al.
D546,699 S 7/2007 Bourne
D546,700 S 7/2007 Bourne
D547,660 S 7/2007 Lepoitevin
D548,083 S 8/2007 Bourne
D550,097 S 9/2007 Lepoitevin
D551,080 S 9/2007 Pedmo et al.
D551,559 S 9/2007 Lepoitevin
D553,992 S 10/2007 Lepoitevin
D556,042 S 11/2007 Lepoitevin
D556,048 S 11/2007 Lepoitevin
D560,506 S 1/2008 Lepoitevin
D567,101 S 4/2008 Pierre
D570,217 S 6/2008 Meillerais
D572,134 S 7/2008 Bourne
D572,135 S 7/2008 Lepoitevin
D575,161 S 8/2008 Lepoitevin
D576,497 S 9/2008 Özer
D581,285 S 11/2008 Lepoitevin
D581,799 S 12/2008 Bourne
(Continued)

*Primary Examiner* — Steven A. Reynolds
*Assistant Examiner* — Prince Pal
(74) *Attorney, Agent, or Firm* — Sterne, Kessler, Goldstein & Fox P.L.L.C.

(57) ABSTRACT

An aseptic-fill beverage container can include a body and a base having a standing ring, a central portion, and an isolation ring that surrounds the central portion. One or more ribs can extend from the isolation ring to the standing ring such that the ribs do not extend outward the standing ring or inward to the central portion. The ribs can be s-shaped to provide rigidity and limit or prevent deformation to the base.

15 Claims, 4 Drawing Sheets

(56) References Cited

U.S. PATENT DOCUMENTS

D582,780 S 12/2008 Bourne
D583,245 S 12/2008 Lepoitevin
D584,627 S 1/2009 Lepoitevin
D584,628 S 1/2009 Lepoitevin
D587,595 S 3/2009 Schuemann
D592,964 S 5/2009 Kissinger et al.
7,543,713 B2 6/2009 Trude et al.
D596,040 S 7/2009 Lepoitevin
D596,489 S 7/2009 Weiss
D598,771 S 8/2009 Kissinger et al.
D598,778 S 8/2009 Lepoitevin
D598,779 S 8/2009 Lepoitevin
D599,671 S 9/2009 Bourne
D600,126 S 9/2009 Lepoitevin
D601,030 S 9/2009 Lepoitevin
D601,034 S 9/2009 Bourne
D601,901 S 10/2009 Lepoitevin
D601,902 S 10/2009 Bourne
D601,903 S 10/2009 Lepoitevin
D601,904 S 10/2009 Lepoitevin
D602,367 S 10/2009 Lepoitevin
D602,370 S 10/2009 Bourne
D602,782 S 10/2009 Lepoitevin
D602,783 S 10/2009 Lepoitevin
D603,268 S 11/2009 Bourne
D603,709 S 11/2009 Lepoitevin
D603,711 S 11/2009 Lepoitevin
D605,952 S 12/2009 Inoi et al.
D606,410 S 12/2009 Kissinger et al.
D607,733 S 1/2010 Lepoitevin
D608,209 S 1/2010 Lepoitevin
7,703,618 B2 * 4/2010 Derrien ..... B65D 1/0261 220/606
7,732,035 B2 6/2010 Pedmo et al.
D620,371 S 7/2010 Bronstein
7,811,079 B2 10/2010 Tonga et al.
D633,793 S 3/2011 Reagan et al.
D638,717 S 5/2011 Schulman et al.
D650,677 S 12/2011 Wurster et al.
D651,091 S 12/2011 Boukobza
8,096,434 B2 * 1/2012 Bunel ..... B65D 1/0284 215/373
8,127,955 B2 3/2012 Denner et al.
D657,683 S 4/2012 Oommen et al.
D658,065 S 4/2012 Oommen et al.
8,256,640 B2 9/2012 Luburic et al.
8,272,863 B2 9/2012 Boukobza
8,381,496 B2 2/2013 Trude et al.
D677,575 S 3/2013 Barnard et al.
8,469,214 B2 * 6/2013 Boukobza ..... B65D 1/0284 220/608
8,524,349 B2 * 9/2013 Protais ..... B65D 1/0284 215/373
8,590,729 B2 11/2013 Kamineni et al.
D699,113 S 2/2014 Haner et al.
D705,068 S 5/2014 Janssen et al.
D705,660 S 5/2014 Colloud
8,875,921 B2 11/2014 Hermel et al.
8,950,611 B2 2/2015 Derrien et al.
8,991,441 B2 3/2015 Gill
8,991,628 B2 * 3/2015 Wurster ..... B65D 1/0261 215/373
9,211,968 B2 12/2015 Melrose
9,227,759 B2 1/2016 Kurihara
D750,966 S 3/2016 Zhou
D753,506 S 4/2016 Veletakos
9,302,805 B2 4/2016 Derrien et al.
D756,233 S 5/2016 Romero Salido
D757,556 S 5/2016 Lesueur
9,387,971 B2 7/2016 Melrose
9,403,625 B2 8/2016 Lembke et al.
9,415,891 B2 * 8/2016 Hermel ..... B65D 1/0284
9,522,749 B2 12/2016 Trude et al.
D782,317 S 3/2017 Zhou
9,713,897 B2 7/2017 Besson et al.
D793,237 S 8/2017 Rotta
D797,563 S 9/2017 Salido
9,758,271 B2 * 9/2017 Hermel ..... B65D 1/0284
D798,722 S 10/2017 Zhou
D799,967 S 10/2017 Wade
9,969,517 B2 5/2018 Melrose
10,065,766 B2 9/2018 Boukobza et al.
10,246,210 B2 * 4/2019 Hermel ..... B65D 1/0284
10,246,238 B2 4/2019 Melrose et al.
10,273,072 B2 4/2019 Melrose
10,414,570 B2 9/2019 Stelzer et al.
10,435,223 B2 10/2019 Melrose et al.
10,435,224 B2 10/2019 Sines
10,683,127 B2 6/2020 Melrose et al.
10,766,683 B2 9/2020 Pritchett, Jr. et al.
10,773,940 B2 9/2020 Lane
10,836,531 B2 * 11/2020 Mahajan ..... B65D 1/0207
10,836,552 B2 11/2020 Melrose et al.
11,008,129 B2 * 5/2021 Pierre ..... B65D 1/0284
2003/0052076 A1 * 3/2003 Cheng ..... B65D 1/0276 215/373
2007/0045220 A1 * 3/2007 Pedmo ..... B65D 1/0284 215/375
2007/0084821 A1 * 4/2007 Bysick ..... B65D 1/0284 215/373
2008/0035601 A1 * 2/2008 Derrien ..... B65D 1/0284 215/376
2008/0093324 A1 * 4/2008 Durand ..... B65D 1/0276 53/396
2009/0218308 A1 * 9/2009 Bunel ..... B65D 1/0284 215/373
2009/0308835 A1 * 12/2009 Boukobza ..... B65D 1/0284 215/370
2010/0297375 A1 * 11/2010 Protais ..... B65D 1/0284 428/36.92
2012/0175337 A1 * 7/2012 Gill ..... B65D 1/0276 215/381
2012/0205342 A1 * 8/2012 Philip ..... B65D 1/42 215/382
2012/0325829 A1 * 12/2012 Haubenschild ..... B65D 1/0284 264/537
2014/0227399 A1 * 8/2014 Wortmann ..... B65D 1/0284 426/106
2014/0360972 A1 * 12/2014 Lane ..... B29C 49/4823 215/382
2015/0034660 A1 * 2/2015 Barel ..... B65D 1/0284 220/608
2015/0136727 A1 * 5/2015 Hermel ..... B65D 1/0284 215/373
2015/0298848 A1 * 10/2015 Hermel ..... B65D 1/0284 215/373
2015/0367979 A1 * 12/2015 Tanaka ..... B65D 79/0081 215/374
2016/0229579 A1 * 8/2016 Pierre ..... B65D 1/0284
2016/0244197 A1 * 8/2016 Hermel ..... B65D 1/0284
2016/0304233 A1 * 10/2016 Hermel ..... B65D 1/0207
2017/0137199 A1 * 5/2017 Tanaka ..... B65D 79/0081
2017/0158370 A1 * 6/2017 Kuhar ..... B65D 1/0246
2018/0162579 A1 * 6/2018 Kado ..... B65D 1/0284
2019/0291935 A1 9/2019 Melrose et al.
2019/0315545 A1 10/2019 Melrose
2019/0322405 A1 * 10/2019 Nakayama ..... B65D 1/0276
2020/0031553 A1 1/2020 Melrose et al.
2020/0189785 A1 * 6/2020 Fonseca ..... B65D 1/0284
2020/0198827 A1 * 6/2020 Dabrowski ..... B65D 1/0284
2021/0061534 A1 3/2021 Tsuchiya et al.
2021/0197996 A1 * 7/2021 Nakayama ..... B65D 1/0284
2021/0362903 A1 * 11/2021 Woloszyk ..... B65D 1/0276

* cited by examiner

FLEXIBLE BASE FOR ASEPTIC-FILL BOTTLES

FIELD

The described embodiments generally relate to bases for bottles. More specifically, described embodiments generally relate to bases for aseptic-fill soft drink beverage bottles.

SUMMARY

In some embodiments, a beverage container can include a body and a base. The base can include a standing ring, a central portion, an isolation ring surrounding the central portion and ribs extending from the isolation ring to the standing ring. Each rib can include an s-shape. In some embodiments, each of the ribs can include a flat segment. Each of the flat segments can extend at an angle relative to a longitudinal axis of the base. In some embodiments, the central portion can include a sidewall. The sidewall of the central portion can be inclined at an angle relative to an interface of the base. In some embodiments, the isolation ring can include a top surface, an outer wall, and an inner wall. The inner wall can extend to the same depth from the top surface as the outer wall of the isolation ring in a neutral state. In some embodiments, the sidewall of the central portion and the inner wall of the isolation ring can meet at an interface of the base. In some embodiments, the central portion can include a flat portion and an apex. The apex can extend upwardly form the flat portion. In some embodiments, the central portion can displace a first distance past a neutral state of the base. The ribs can displace a second distance past the neutral state, the first distance greater than the second distance. In some embodiments, the ribs do not extend outward from the standing ring.

In some embodiments, a base for a beverage container can include a standing ring and ribs. The ribs can extend radially inward from the standing ring. Each rib can include a first curved segment, a second curved segment, and a flat segment extending at an angle relative to a longitudinal axis of the base between the first curved segment and the second curved segment. In some embodiments, the inner side can further include a central portion and an isolation ring surrounding the central portion and disposed between the central portion and the ribs. In some embodiments, the ribs do not extend radially inward to the central portion. In some embodiments, each rib can include a height measured from a horizontal plane defined by the standing ring and a width. The height can be greater than the width. In some embodiments, the ribs do not extend outward of the standing ring. In some embodiments, the inner side comprises between 20 and 30 ribs.

In some embodiments, a base for a beverage container can include a standing ring, a flexible central portion, an isolation ring surrounding the central portion, and a rigid portion having ribs. The ribs can extend between the standing ring and the isolation ring. The ribs can be separated from the central portion by the isolation ring. The flexible central portion can displace a first distance past a neutral state of the base in a first state in which the base flexes inward. The rigid portion can displace a second distance past the neutral state in the first state, the first distance greater than the second distance. In some embodiments, the ribs can be s-shaped. In some embodiments, each rib can include a first curved segment, a second curved segment, and a flat segment extending at an angle relative to a longitudinal axis of the base between the first curved segment and the second curved segment. In some embodiments, the flexible central portion can displace a third distance past a neutral state in a second state in which the base flexes outward. The rigid portion can displace a fourth distance past the neutral state in the second state, the third distance greater than the fourth distance. In some embodiments, the first state and the second state can be caused by a pressure differential of approximately 2 psi. In some embodiments, the flexible central portion can include a diameter that is approximately 60% of a diameter of the base.

BRIEF DESCRIPTION OF THE DRAWINGS

The accompanying drawings, which are incorporated herein and form a part of the specification, illustrate embodiments of the present disclosure by way of example, and not by way of limitation. Together with the description they further serve to explain principles of the disclosure and enable a person skilled in the pertinent art to make and use the disclosure.

DETAILED DESCRIPTION

Figure 1:
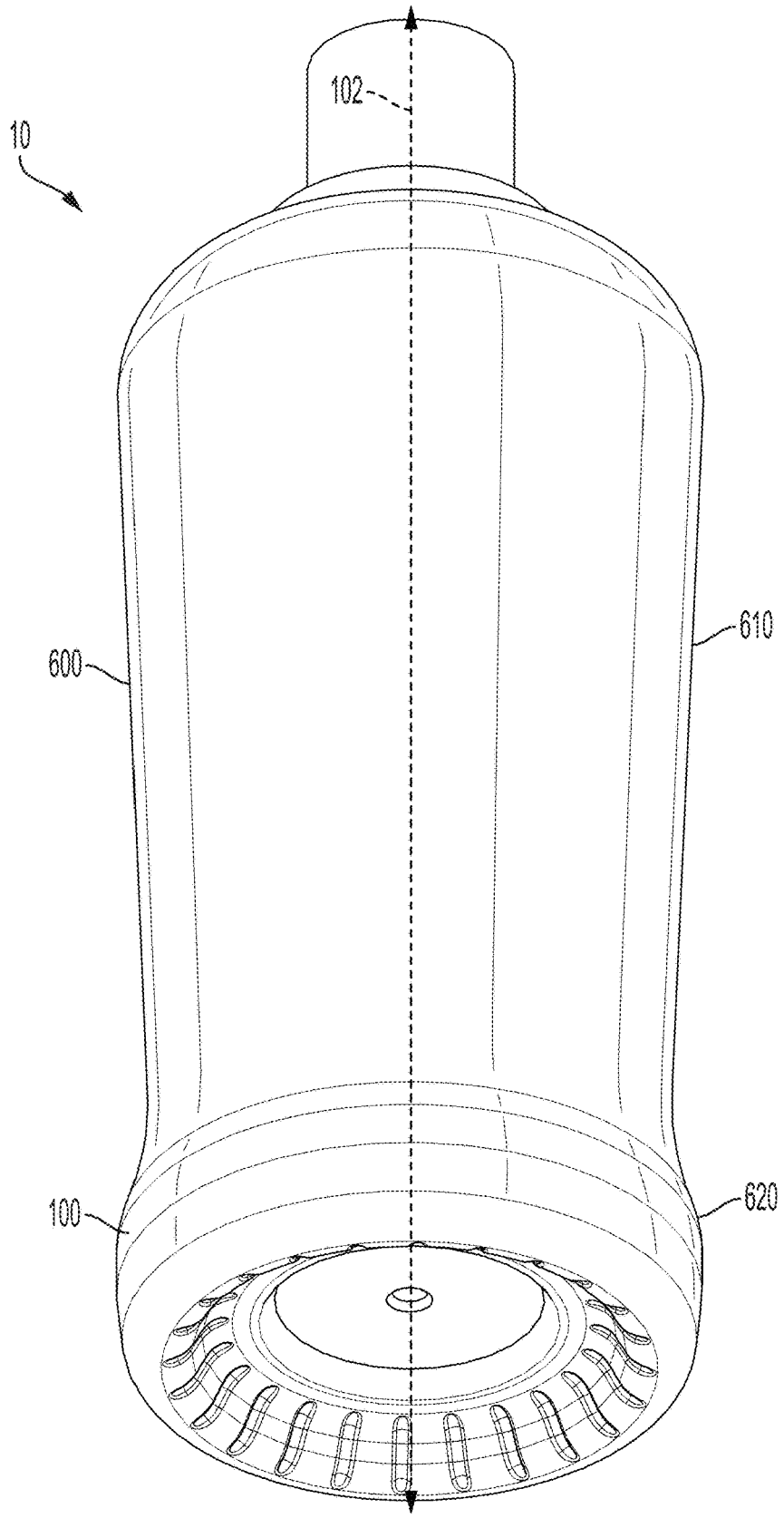
FIG. 1 is a bottom perspective view of a beverage container having a base according to some embodiments.

The present invention will now be described in detail with reference to embodiments thereof as illustrated in the accompanying drawings. References to "one embodiment," "an embodiment," "an example embodiment," "some embodiments," etc., indicate that the embodiment described may include a particular feature, structure, or characteristic, but every embodiment described may not necessarily include that particular feature, structure, or characteristic. Similarly, other embodiments may include additional features, structures, or characteristics. Moreover, such phrases are not necessarily referring to the same embodiment. When a particular feature, structure, or characteristic is described in connection with the embodiment, it is submitted that it is within the knowledge of one skilled in the art to effect such feature, structure, or characteristic in connection with other embodiments whether or not explicitly described.

The terms "invention," "present invention," "disclosure," or "present disclosure" as used herein are non-limiting terms and are not intended to refer to any single embodiment of the particular invention but encompasses all possible embodiments as described in the application.

Plastic beverage containers can be filled with variety of beverages. During a filling process, containers can deform. Containers can have a construction to limit or prevent deformation. For example, plastic beverage containers have a variety of bases. Each base is designed to withstand pressure differences that can develop between the interior of a sealed beverage container and the outside atmosphere. The pressure differential experienced in the beverage container can be an underpressure, like a vacuum (i.e., a lower relative pressure within the container than outside of it), or an overpressure (i.e., a higher relative pressure within the container than outside of it), either of which can promote container deformation. In some cases, the pressure differential can change. Such change may be the result of a filling process or a change in the container's environment. For example, if a container is filled with hot liquid and then sealed, subsequent cooling of the liquid can cause it to thermally contract, reducing its volume and creating an internal vacuum. This can pull the container base and sidewall inward and cause deformation. Other causes of a pressure differential and vacuum include changes in elevation, exterior temperature, and product oxidation.

Containers can be designed to limit or prevent the deformation caused by a pressure differential within the container and the resultant vacuum. Some container designs can compensate for pressure differentials at their sidewalls. These containers can have thicker sidewalls, vacuum panels in the sidewalls that move to change an interior volume by an amount sufficient to compensate for a change in liquid volume, or reinforcing structures on their sidewalls to resist movement when subject to a pressure differential (e.g., circular grooves around the container to provide "hoop" strength). Thus, as a vacuum is caused, the container sidewall can accommodate or resist deformation, or both, depending on its design. Additionally or alternatively, containers can have active bases that invert (e.g., move in or out) in a controlled way. For example, as a liquid cools and its volume decreases, the base can be inverted (e.g., by a mechanical operation that presses an invertible area of the base inward) to reduce the volume of the container, thereby filling the volume gap between the liquid and the nominal (un-stressed) volume of the container. Accordingly, the active bases can accommodate the vacuum to limit or prevent deformation elsewhere. This can be helpful to give bottle designers more design freedom in designing bottle sidewalls, by reducing the need to incorporate compensatory structures in the sidewalls.

Plastic containers can be light and thin, such as in comparison to glass containers. But significant amounts of material can still be required in containers that compensate for pressure differentials by strengthening their sidewalls or including active bases. The added material can cause these containers to become heavy and expensive to produce. Such designs can also be complex, requiring precise tooling and impeding container design freedom.

In hot filling processes, the pressure differential can be relatively large (e.g., 4-5 psi or more) as a liquid is filled at hot temperatures (e.g., between 150 and 200 degrees Fahrenheit) and then cooled to room temperature (e.g., between 65 and 75 degrees Fahrenheit) or below, which causes a large vacuum and the need to incorporate correspondingly large compensatory structures to manage and avoid deformation. Thus, having thicker sidewalls or active bases can be advantageous in hot filling to compensate for the larger pressure differential within the container and the resultant vacuum. Not all containers are filled in hot filling processes though. A container filled by, for example, an aseptic filling process can experience a lower pressure differential within the container and, thus, may not require the robust design required in hot filling.

Due to the relative popularity of hot-filling processes as opposed to aseptic filling processes, aseptic filling processes have used hot-fill bottle designs. Because hot-fill bottles can accommodate the relatively larger pressure differentials of the hot-fill process, they also could accommodate the relatively lower pressure differentials of aseptic fill processes. But in many cases, the hot-fill bottles are overkill for the aseptic fill process. The robust designs required in hot filling applications are more than is necessary to meet the needs of aseptic filling. Consequently, they use more material and are more complex than is needed in an aseptic-fill process. More specifically, the pressure differential can be smaller for an aseptic-fill process since the process does involve the temperature extremes experienced in hot filling. Instead of a larger pressure differential of 4-5 psi or more (as is common in a hot-fill process), aseptic filling can cause a lower pressure differential of approximately 2 psi. A lighter construction that could accommodate the lower pressure differentials of aseptic filling and limit or prevent the resultant vacuum would save material, weight, waste, and cost. Therefore, a need exists for containers directed to aseptic filling that can accommodate and limit deformation in a way more tailored to the characteristics of the aseptic-fill processes.

Embodiments of the present invention provide a base having a structural geometry that accommodates pressure differentials experienced in aseptic filling. Specifically, embodiments relate to controlling deformations of the base of a plastic beverage container as it experiences lower pressure differenced with its outside atmosphere (e.g., within 2 psi), both in an overpressure and an underpressure state. The base includes structural features to accommodate pressure differentials such that the container can be lightweight and simple to manufacture.

As described herein, the base can include a central flexible portion. The base can also include a rigid portion surrounding the flexible portion and separated from the flexible portion by an isolation ring. The flexible portion can function as a diaphragm to accommodate pressure differentials, and the rigid portion can provide structural stability to control deformation to the base outside of the flexible portion.

The base can move between an over-pressured state, an under-pressured state, and a neutral state. At formation of the container, the base can be in the neutral state. When the container is filled with warm contents and sealed, the container can experience over-pressurization, which can cause the base to move (at its flexible portion) to be in the over-pressured state. In the over-pressured state, the flexible portion of the base can flex outward of the neutral state (i.e., downward when the bottle is in an upright orientation). As contents of the sealed container cool and reduce in volume (due to thermal contraction), the container can experience under-pressurization, which can cause the base to move (at its flexible portion) inward of the neutral state to be in the under-pressured state. The flexible portion can experience greater displacement than the rigid portion as a function of the pressure differential. In this way, the rigid portion is more rigid and less flexible relative to the flexible portion.

Stress can be distributed about the rigid portion. The rigid portion can include the standing ring of the container and ribs that extend between the standing ring and the central portion. The standing ring of the rigid portion can be the surface-contacting portion of the container, which allows the container to remain upright and stable when placed upright on a surface during use. The ribs of the rigid portion can be distributed radially to inhibit flexing in the area of the base outward of the isolation ring. Accordingly, stress on the base can be distributed between the ribs and the standing ring to minimize points of stress concentrations. Additionally, the ribs can be s-shaped such that the geometry along with the size, quantity, and separation of the ribs can influence stress distribution to maintain the rigidity of the rigid portion.

The base for a plastic beverage container described herein enables accommodation of pressure differentials experienced in aseptic filling while reducing material, weight, waste, and cost. Embodiments are discussed below with reference to the figures.

As shown in FIG. 1, a beverage container 10 can include a base 100 and body 600. Beverage container 10 and components thereof can be formed of a polymer material (e.g., polyethylene terephthalate (PET) or a PET blend of PET with another polymer or additive, including recycled PET) blow-molded from a preform. Body 600 can include a sidewall 610. In some embodiments, base 100 can include a skirt 620. Base 100 can extend from sidewall 610. Base 100 can include a longitudinal axis 102 extending vertically through its center. Longitudinal axis 102 can define central axis for beverage container 10 and base 100. In some embodiments, beverage container 10, base 100, or beverage container 10 and base 100 can be symmetric across a vertical plane that includes longitudinal axis 102. In some embodiments, beverage container 10, base 100, or beverage container 10 and base 100 are not symmetric across a vertical plane that includes longitudinal axis 102. For example, in some embodiments, base 100 may be symmetric but sidewall of container 10 may not be symmetric. Skirt 620 of base 100 can extend from sidewall 610 towards longitudinal axis 102.

Figure 2:
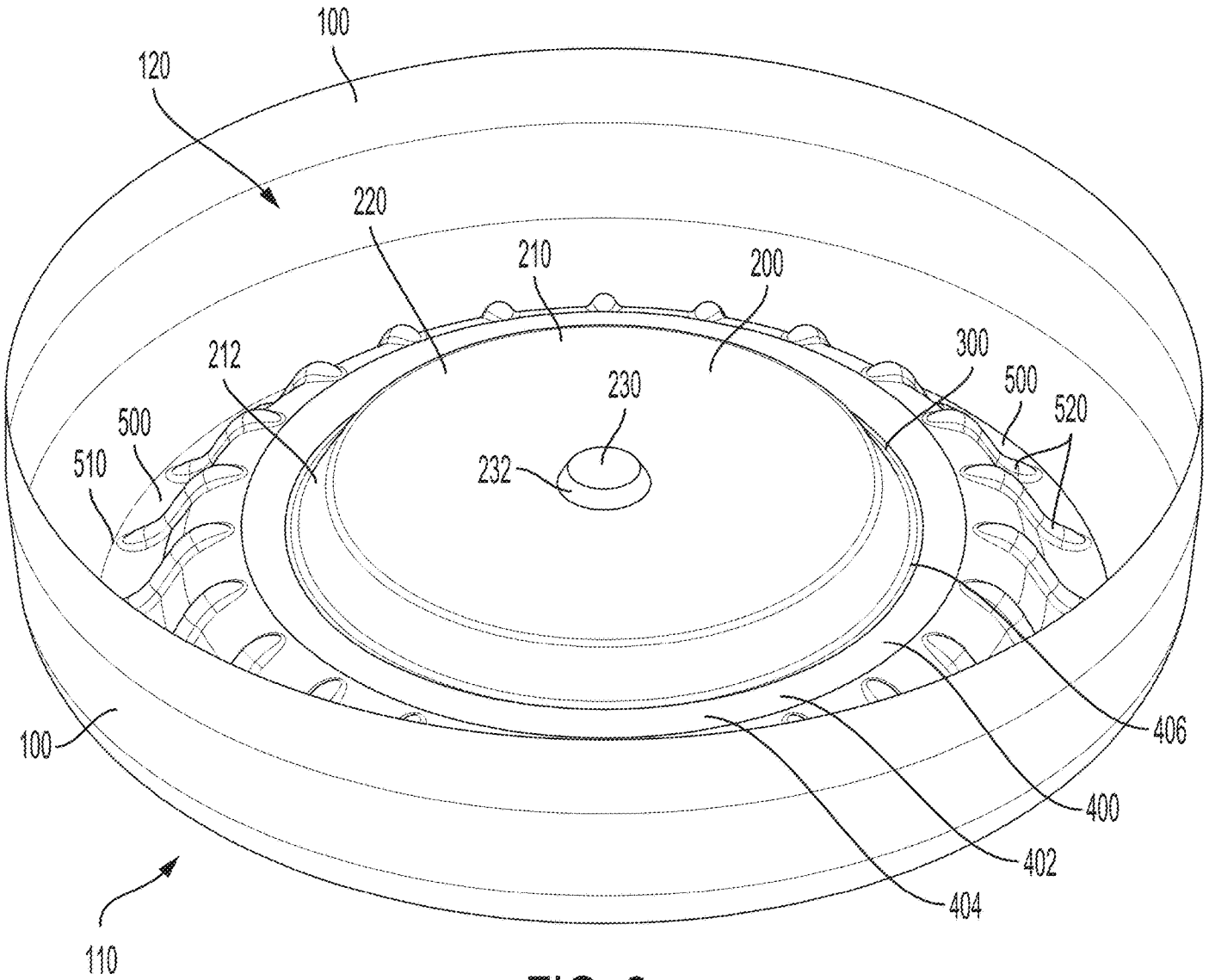
FIG. 2 is a top interior perspective view of the base of the beverage container of FIG. 1.
Figure 3:
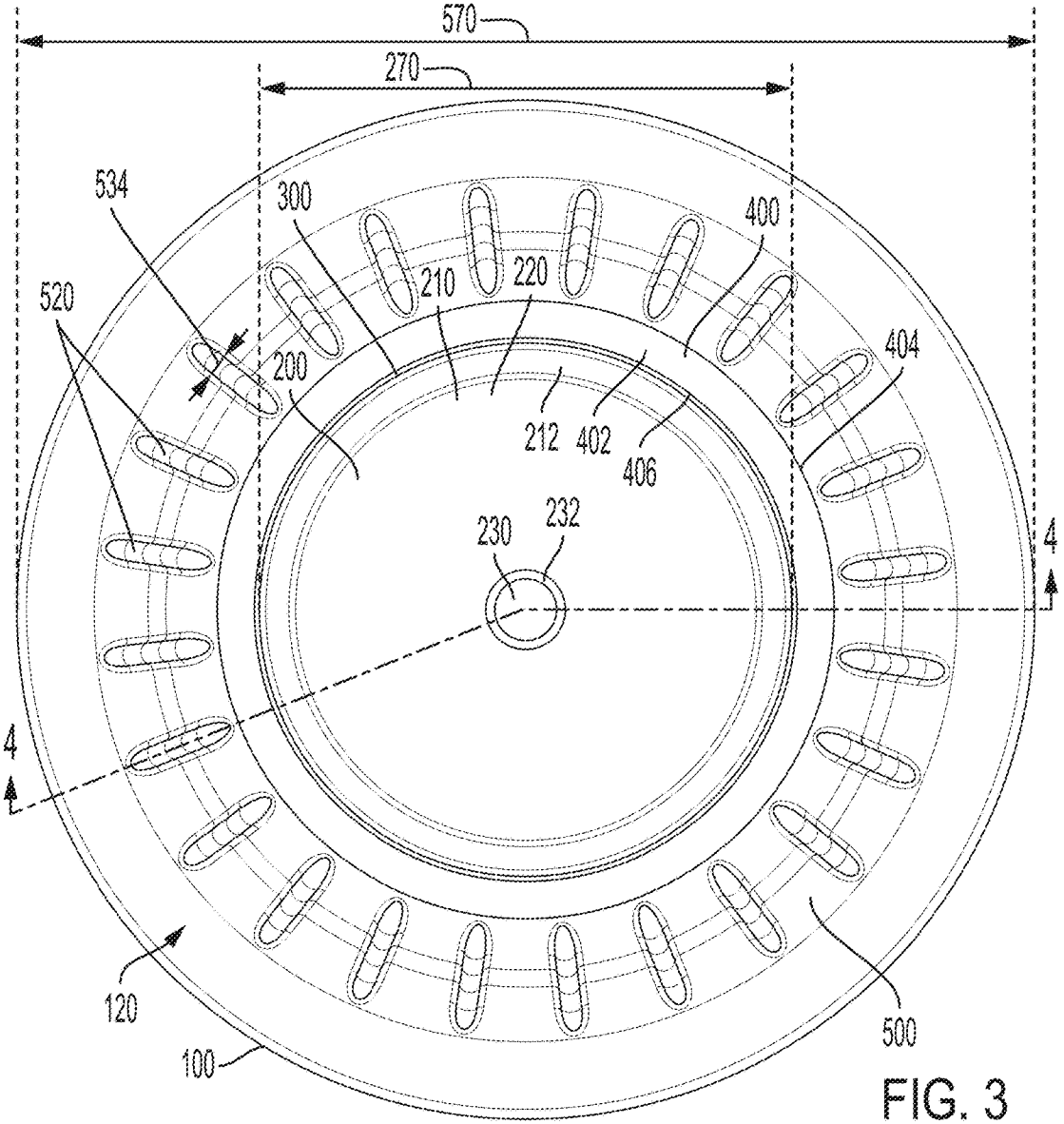
FIG. 3 is a top interior view of the base of the beverage container of FIG. 1.

FIGS. 2-3 show a perspective view and a top view, respectively of base 100. In some embodiments, base 100 can be transparent, but is shown in the figures without transparency for clarity of illustration. Base 100 can include an outer side 110 and an inner side 120. Outer side 110 of base 100 can be the exterior part of base 100. Inner side 120 of base 100 can be the interior of base 100, such as when viewed within beverage container 10. Base 100 can include a flexible portion 200, an isolation ring 400, and a rigid portion 500. Flexible portion 200 can function as a diaphragm and can include a central portion 210. Central portion 210 can include a sidewall 212, a flat portion 220, and an apex 230. Isolation ring 400 can include a top surface 402, an outer wall 404, and an inner wall 406. Rigid portion 500 can include a standing ring 510 and one or more ribs 520.

In some embodiments, base 100 can include between 20 and 30 ribs 520. Base 100 including more than 20 ribs 520 can help to more evenly distribute the pressure and resistance to it. In this way, each rib 520 can have less pressure to resist and base 100 as a whole can resist it more evenly than if base 100 had fewer ribs 520. Ribs 520 can extend between standing ring 510 and flexible portion 200. Additionally, isolation ring 400 can surround central portion 210. In this way, isolation ring 400 can separate ribs 520 from central portion 210. Accordingly, in some embodiments, ribs 520 can extend from isolation ring 400 to standing ring 510 such that ribs 520 do not extend past standing ring 510. In other words, ribs 520 can extend radially inward from standing ring 510 such that ribs 520 do not extend radially inward to central portion 210. Thus, ribs 520 do not extend into central portion 210. In some embodiments, ribs 520 do not extend outward of standing ring 510. Standing ring 520 may be continuous. Thus, the visual prominence of ribs 520 when viewing base 100 from outer side 110 may be reduced or eliminated. For example, ribs 520 may not be visible when container 10 is placed on a flat surface (except for visibility through another portion of container 10, in the case where portions of container 10 are transparent). Similarly, in some embodiments, skirt 620 (FIG. 1) can minimize the visual prominence of base 100 from outer side 110.

With reference to FIG. 3, in some embodiments, flexible portion 200 can include an interface 300. In some embodiments, sidewall 212 of central portion 210 and inner wall 406 of isolation ring 400 can meet at interface 300. In this way, interface 300 can be disposed between central portion 210 and isolation ring 400. Interface 300 can be a radial edge that surrounds central portion 210. Accordingly, interface 300 can be radially outward of central portion 210 and radially inward of isolation ring 400.

In some embodiments, the transition from sidewall 212 of central portion, interface 300, and inner wall 406 of isolation ring 400 can be smooth. Accordingly, the transitions between the surfaces thereof can be rounded such that they have a radius. In some embodiments, base 100 can include smooth transitions between every surface to minimize stress concentrations in base 100. Minimizing stress concentrations allows base 100 to be formed with less material, reducing costs and weight. Additionally, minimizing stress concentrations can allow for stress distribution such that deformation to base 100 can be controlled (e.g., focused on the flexible portion). As described herein, stress can be distributed throughout base 100 between flexible portion 200 and rigid portion 500 such that deformation to base 100 can be controlled.

As shown in FIG. 2, in some embodiments, flexible portion 200 can include central portion 210 having apex 230. In some embodiments, apex 230 is not included. In some embodiments, apex 230 of central portion 210 can extend upwardly from flat portion 220 of central portion 210. Apex 230 can have a sidewall 232 angled upward from flat portion 220. Apex 230 can be aligned with longitudinal axis 102. Apex 230 can be the highest point of central portion 210 when base 100 is placed on a horizontal surface 5. As beverage container 10 (FIG. 1) experiences over-pressurization and under-pressurization, apex 230 can move as part of flexible portion 200. In some embodiments, the transition from flat portion 220 to apex 230 is smooth.

As shown in FIG. 3, base 100 can have an overall diameter 570. Flexible portion 200 can have a diameter 270 that is proportional to diameter 570. In some embodiments, diameter 270 can be 60% of diameter 570. In some embodiments, diameter 270 can be between 50% and 70% of diameter 570. In some embodiments, diameter 270 can be 10 millimeters. In some embodiments, diameter 270 can be between 6 millimeters and 12 millimeters. Flexible portion 200 bounded by central portion 210 can be small in comparison to central portions of hot-fill bases. Indeed, in some hot-fill bases, the central portion is between 80 and 90% of the base diameter. Hot-fill bases require larger central portions to accommodate larger pressure changes. Some hot-fill bases are active and invert to accommodate vacuums caused by larger pressure changes. Because aseptic filling experiences lower pressure changes, flexible portion 200 of base 100 can be smaller in comparison to central areas of hot-fill bases, and smaller relative to diameter 570 of base 100.

Figure 4:
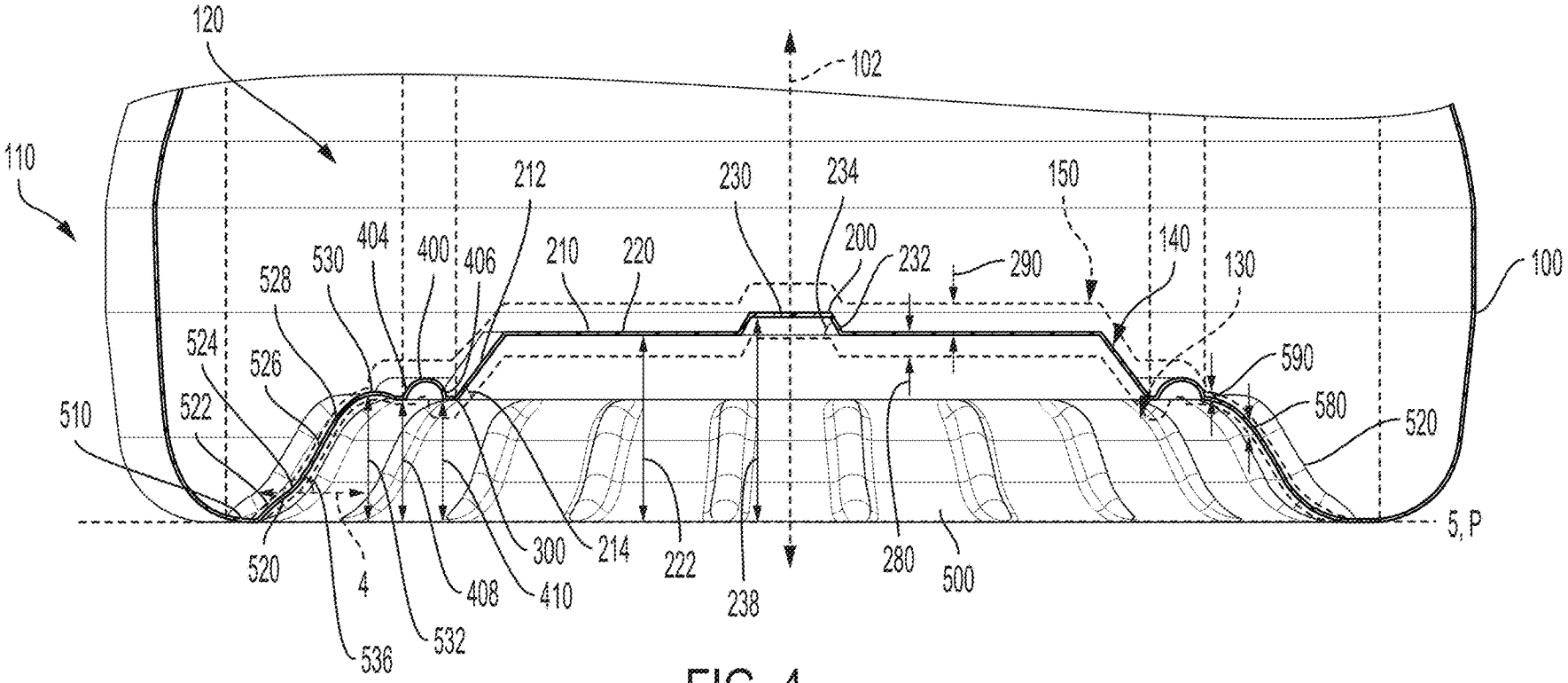
FIG. 4 is a cross section view of the base of FIG. 3 taken along the line 4-4' of FIG. 3.

FIG. 4 shows a cross section of base 100 taken at the line 4-4' shown in FIG. 3. The cross section of FIG. 4 extends through a rib 520 on the left side, and between ribs 520 on the right side. As shown in FIG. 4, ribs 520 can be s-shaped. Ribs 520 can include a first curved segment 522, a first inflection point 524, a second inflection point 528, and a second curved segment 530. First inflection point 524 can define the endpoint of first curved segment 522. Second inflection point 528 can define the endpoint of second curved segment 530. First inflection point 524 and second inflection point 528 can be connected by a flat segment 526. Thus, flat segment 526 can separate the curved portions, first curved segment 522 and second curved segment 530, of each rib 520 such that rib 520 is s-shaped. In some embodiments, first inflection point 524 and second inflection point 528 are at the same point, and there is no flat segment.

Ribs 520 can extend upward from standing ring 510. In this way, each rib 520 can have a height 532. Height 532 can measured from a horizontal plane P defined by standing ring 510 to second curved segment 530. In some embodiments, horizontal plane P and horizontal surface 5 are coplanar. In some embodiments, height 532 can be relatively small in comparison to other dimensions of base 100 (e.g., diameter 270, diameter 570, and the height of central portion 210 and components thereof, which is described below). For example, height 532 can be less than 7 millimeters. In some embodiments, height 532 can be 3.5 millimeters. In some embodiments, height 532 can be less than 15% of the maximum diameter 570 of base 100, such as between 8% and 12%, such as 10%. Each rib 520 can also include a width 534 (FIG. 3). Height 532 can be greater than width 534. Accordingly, width 534 can also be relatively small in comparison to other dimensions of base 100 (e.g., diameter 270, diameter 570, and the height of central portion 210 and components thereof). Minimizing height 532 and width 534 (FIG. 3) can reduce the prominence of ribs 520 such that base 100 can require less material. Accordingly, base 100 can be lighter and less costly.

Ribs 520 can extend upward from standing ring 510 to isolation ring 400 such that ribs 520 extend at an angle relative to a horizontal axis 4, which is perpendicular to longitudinal axis 102. Flat segment 526 of each rib 520 can extend upward at an angle 536 relative to horizontal axis 4 between first curved segment 522 and second curved segment 530. Ribs 520 can extend at an angle in this way to facilitate blow molding. Sidewall 212 of central portion 210 can extend toward apex 230 at an angle 214 relative to interface 300. Sidewall 232 of apex 230 can extend upward from flat portion 220 of central portion 210 at an angle 234 relative to flat portion 220. In some embodiments, angle 536 of rib 520 can be shallower or greater than angle 214 of central portion 210. In some embodiments, angle 536 can be 45°. In some embodiments, angle 536 can be between 30° and 60°.

As shown in FIG. 4, base 100 can move between a neutral state 140, an over-pressured state 130, and an under-pressured state 150. At formation of beverage container 10, base 100 can be in neutral state 140. When beverage container 10 is filled with warm contents (e.g., beverage liquid) and sealed (e.g., by the application of a bottle cap), base 100 can experience over-pressurization to be in over-pressured state 130. In over-pressured state 130, base 100 can flex outward of neutral state 140. As the contents of beverage container 10 cool and reduce in volume, base 100 can experience under-pressurization and can flex inward of neutral state 140 to be in under-pressured state 150. Under-pressured state 150 can coincide with a vacuum being caused within the bottle as the contents of beverage container 10 cool and reduce in volume. Thus, base 100 can be flexible to accommodate pressure differentials and limit or prevent deformation to base 100. In some embodiments, over-pressured state 130 and under-pressured state 150 can be caused by a pressure differential of approximately 2 psi.

Flexible portion 200 of base 100 can displace a vertical first distance 280 past neutral state 140 of base 100 in over-pressured state 130. Accordingly, central portion 210 of flexible portion 200 can displace first distance 280 past neutral state 140 of base 100 in over-pressured state 130. Rigid portion 500 of base 100 can displace a vertical second distance 580 past neutral state 140 of base 100 in over-pressured state 130. Accordingly, ribs 520 of rigid portion 500 can displace second distance 580 past neutral state 140 of base 100 in over-pressured state 130. First distance 280 can be greater than second distance 580.

Similarly, flexible portion 200 of base 100 can displace a vertical third distance 290 past neutral state 140 of base 100 in under-pressured state 150. Accordingly, central portion 210 of flexible portion 200 can displace third distance 290 past neutral state 140 of base 100 in under-pressured state 150. Rigid portion 500 of base 100 can displace a vertical fourth distance 590 past neutral state 140 of base 100 in under-pressured state 150. Accordingly, ribs 520 of rigid portion 500 can displace fourth distance 590 past neutral state 140 of base 100 in under-pressured state 150. Third distance 290 can be greater than fourth distance 590.

Thus, flexible portion 200 can experience greater displacement than rigid portion 500 as a function of the pressure differential. In this way, rigid portion 500 is more rigid and less flexible relative to flexible portion 200. In other words, central portion 210 can experience greater displacement than ribs 520, as ribs 520 are more rigid and less flexible relative to central portion 210. The displacement distance is proportional to the volume of beverage container 10. A larger beverage container 10 can support a greater displacement distance. Similarly, a smaller beverage container 10 can support a smaller displacement distance. The weight of beverage container 10 can also influence the displacement distance. For example, a beverage container 10 that is lighter can support a greater displacement distance in comparison to a beverage container 10 of the same volume that is heavier. Similarly, a beverage container 10 that is heavier can support a smaller displacement distance in comparison to a beverage container 10 of the same volume that is lighter.

Ribs 520 can provide the rigidity of rigid portion 500. As discussed above, ribs 520 can be angled upward from standing ring 510 to flexible portion 200. With reference to FIG. 3, in some embodiments, standing ring 510 can be continuous around base 100. In this way, standing ring 510 does not have intermediate gaps and ribs 520 are distributed radially around base 100. With reference to FIG. 4, as standing ring 510 can be the surface contacting portion of beverage container 10 (FIG. 1), standing ring 510 can be a lowest point of base 100 relative to longitudinal axis 102 of base 100. Additionally, central portion 210 can be a highest point of base 100 relative to longitudinal axis. In some embodiments, apex 230 of central portion 210 can be a highest point of base 100 relative to longitudinal axis. The profile of base 100 having a highest point at central portion 210 and a lowest point at standing ring 510 can facilitate blow molding. In contrast, bases having one or more intermediate walls between a standing ring and central portion, instead of angled ribs, can impede outward flow of plastic to a standing ring such that successful blow molding is disrupted or more difficult. Base 100 described herein does not require intermediate walls for rigidity because of the rigidity provided by ribs 520. Ribs 520 can also flex with rigid portion 500 and can displace in over-pressured state 130 and under-pressured state 150. The s-shape of ribs 520 can contribute to the rigidity and controlled, minimal flexing of ribs 520. However, ribs 520 do not buckle or change their basic shapes to accommodate pressure changes within beverage container 10.

Isolation ring 400 can contain flexibility in flexible portion 200 by surrounding central portion 210 of flexible portion 200 and separating ribs 520 from central portion 210. Isolation ring 400 containing flexibility in flexible portion 200 allows flexible portion 200 to flex upward and downward, but inhibits outward flexing. The separation of flexible portion 200 by isolation ring 400 can also help rigid portion 500 to remain more rigid and less flexible relative to flexible portion 200.

In some embodiments, inner wall 406 of isolation ring 400 can extend to a greater depth from top surface 402 than outer wall 404 of isolation ring 400. In other words, outer wall 404 can have a height 408 and inner wall 406 can have a height 410. In some embodiments, height 410 can be greater than height 408, where height 408 and height 410 are measured from horizontal surface 5. In some embodiments, height 410 can be the same as height 408. Accordingly, inner wall 406 of isolation ring 400 can extend to the same depth from top surface 402 as outer wall 404 of isolation ring 400. In some embodiments, height 408 and height 410 can depend on angle 536 of the extension of ribs 520. For example, a larger angle 536 can result in a larger height 408 and height 410. Similarly, a smaller angle 536 can result in a smaller height 408 and height 410. In some embodiments, height 408 and height 410 can differ between a range of one millimeter and four millimeters, such as two millimeters. In some embodiments, height 408 and height 532 of ribs 520 can be comparable. In some embodiments, height 408 and height 532 can differ between a range of one millimeter and four millimeters, such as two millimeters.

Additionally, flat portion 220 of central portion 210 can have a height 222. In some embodiments, apex 230 can have a height 238 that is greater than height 222, where height 222 and height 238 are measured from horizontal surface 5. Height 222 and height 238 can be small in comparison to heights of central portions in hot-fill bases. Hot-fill bases require larger central portions to accommodate larger pressure changes. Some hot-fill bases are active and invert to accommodate vacuums caused by larger pressure changes and so require taller central portions. Because aseptic filling experiences lower pressure changes, height 222 and height 238 can be smaller. Minimizing height 222 and height 238 can also reduce the prominence of central portion 210 such that base 100 can require less material. Accordingly, base 100 can be lighter and less costly. In some embodiments, height 238 can be a percentage of diameter 570 of base 100. In some embodiments, height 238 can be between 5% and 25% of diameter 570, such as between 10% and 20%, such as 15%.

It is to be appreciated that the Detailed Description section, and not the Summary and Abstract sections, is intended to be used to interpret the claims. The Summary and Abstract sections may set forth one or more but not all exemplary embodiments of the present disclosure but are not intended to limit the present disclosure and claims in any way.

The foregoing description of the specific embodiments so fully reveal the general nature of the disclosure that others can, by applying knowledge within the skill of the art, readily modify and/or adapt for various applications such specific embodiments, without undue experimentation, without departing from the general concept of the present disclosure. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The breadth and scope of the present disclosure should not be limited by any of the above-described exemplary embodiments, but should be defined only in accordance with the claims and their equivalents.

What is claimed is:

1. A beverage container comprising:
a body extending along a central longitudinal axis; and
a base comprising:
a standing ring;
a central portion;
an isolation ring surrounding the central portion, wherein the isolation ring forms a continuous peak extending around the central portion, and the isolation ring comprises an inner wall extending axially away from the peak;
an interface between the isolation ring and the central portion, wherein the inner wall and the central portion extend in a same axial direction away from the interface; and
ribs extending from the isolation ring to the standing ring, each rib comprising an s-shape.

2. The beverage container of claim 1, wherein each of the ribs comprise:
a flat segment,
wherein each of the flat segments extends at an angle relative to the longitudinal axis.

3. The beverage container of claim 1, wherein the central portion comprises:
a sidewall;
wherein the sidewall of the central portion is inclined at an angle relative to the interface.

4. The beverage container of claim 3, wherein the isolation ring comprises:
a top surface; and
an outer wall;
wherein the inner wall extends to the same depth from the top surface as the outer wall of the isolation ring in a neutral state.

5. The beverage container of claim 4, wherein the sidewall of the central portion and the inner wall of the isolation ring meet at the interface.

6. The beverage container of claim 1, wherein the central portion comprises:
a flat portion; and
an apex;
wherein the apex extends upwardly from the flat portion.

7. The beverage container of claim 1, wherein the central portion is configured to displace a first distance past a neutral state of the base, and
wherein the ribs are configured to displace a second distance past the neutral state, the first distance greater than the second distance.

8. The beverage container of claim 1, wherein the ribs do not extend outward from the standing ring.

9. A base for a beverage container, the base comprising:
a standing ring;
a flexible central portion;
an isolation ring surrounding the central portion; and
a rigid portion comprising ribs, the ribs extending between the standing ring and the isolation ring, the ribs separated from the flexible central portion by the isolation ring,
wherein the flexible central portion displaces a first distance past a neutral state of the base in a first state in which the base flexes inward, wherein the rigid portion displaces a second distance past the neutral state in the first state, the first distance greater than the second distance, and wherein the isolation ring expands from the neutral state to the first state.

10. The base of claim 9, wherein the ribs are s-shaped.

11. The base of claim 9, wherein each rib comprises a first curved segment, a second curved segment, and a flat segment extending at an angle relative to a longitudinal axis of the base between the first curved segment and the second curved segment.

12. The base of claim 9, wherein the flexible central portion displaces a third distance past a neutral state in a second state in which the base flexes outward, and wherein the rigid portion displaces a fourth distance past the neutral state in the second state, the third distance greater than the fourth distance.

13. The base of claim 12, wherein the first state and the second state are caused by a pressure differential of approximately 2 psi.

14. The base of claim 9, wherein the flexible central portion comprises a diameter that is approximately 60% of a diameter of the base.

15. The beverage container of claim 1, wherein the peak is an extremity of the isolation ring in an axial direction, and the central portion extends beyond the peak in the axial direction.

* * * * *